US005639231A

United States Patent [19]

May et al.

[11] Patent Number: 5,639,231

[45] Date of Patent: Jun. 17, 1997

[54] MANTLE AND SPRING CLIP ASSEMBLY

[75] Inventors: Randall L. May, Andover, Kans.; J. Michael Murray, Highlands Ranch, Colo.; Lance V. Swearingen, Wichita, Kans.; Vernon J. Taylor, Wichita, Kans.; Robert O. Van Driest, Wichita, Kans.

[73] Assignee: The Coleman Company, Inc., Wichita, Kans.

[21] Appl. No.: 501,899

[22] Filed: Aug. 9, 1995

[51] Int. Cl.[6] ..... F21H 1/00

[52] U.S. Cl. ..... 431/113; 431/111; 431/100

[58] Field of Search ..... 431/100–113; 24/27; 362/179

[56] References Cited

U.S. PATENT DOCUMENTS

| | | | |
|---|---|---|---|
| 919,645 | 4/1909 | Rybar . | |
| 935,241 | 9/1909 | Weyer . | |
| 982,258 | 1/1911 | Harding . | |
| 1,006,085 | 10/1911 | Harding . | |
| 1,169,411 | 1/1916 | Lockwood | 431/107 |
| 1,227,260 | 5/1917 | Gotty . | |
| 1,557,111 | 10/1925 | Rutledge | 24/27 |
| 1,906,255 | 5/1933 | Engh . | |
| 2,506,706 | 5/1950 | Colle . | |
| 2,629,908 | 3/1953 | Keck . | |
| 2,685,719 | 8/1954 | Golden . | |
| 2,703,000 | 3/1955 | Hebard . | |
| 2,715,825 | 8/1955 | Zimmerman . | |
| 3,132,396 | 5/1964 | Berman | 24/27 |
| 3,589,850 | 6/1971 | Teeter . | |
| 3,649,157 | 3/1972 | Klauer . | |
| 3,796,534 | 3/1974 | Andrews . | |
| 4,041,931 | 8/1977 | Elliott . | |
| 4,280,722 | 7/1981 | Guptil . | |
| 4,426,682 | 1/1984 | Hashimoto . | |
| 4,533,317 | 8/1985 | Addison . | |
| 4,583,268 | 4/1986 | Horcher born Kloss . | |
| 4,881,893 | 11/1989 | Mellini | 431/100 |
| 5,048,159 | 9/1991 | Johansson . | |
| 5,104,312 | 4/1992 | Dowst . | |
| 5,116,220 | 5/1992 | Kinzel et al. | 431/100 |
| 5,185,907 | 2/1993 | Kawashima . | |
| 5,404,620 | 4/1995 | Calmettes . | |

FOREIGN PATENT DOCUMENTS

| | | | |
|---|---|---|---|
| 2030901 | 12/1971 | Germany | 431/100 |
| 2206643 | 8/1973 | Germany . | |
| 7-25502 | 5/1995 | Japan . | |
| 70027 | 2/1946 | Norway . | |
| 406879 | 8/1966 | Switzerland . | |
| 141 | 10/1909 | United Kingdom . | |
| 5010 | 11/1909 | United Kingdom . | |
| 7979 | 8/1913 | United Kingdom . | |
| 9862 | 2/1914 | United Kingdom . | |
| 328224 | 4/1930 | United Kingdom . | |
| 339682 | 12/1930 | United Kingdom . | |
| 643638 | 9/1950 | United Kingdom . | |

*Primary Examiner*—James C. Yeung

[57] ABSTRACT

A mantle assembly includes a mantle having at least one open end and a spring clip at the open end for attaching the open end of the mantle to the burner assembly of a lantern. The spring clip includes a generally circular central portion which surrounds the mantle opening and a pair of end portions. The end portions are movable between first and second positions for changing the size of the opening of the central portion. The mantle can have a generally tubular shape with a pair of open ends, and a spring clip surrounds each open end.

23 Claims, 7 Drawing Sheets

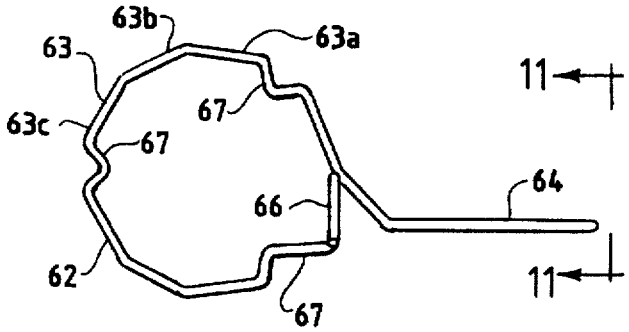
FIG. 9
FIG. 11
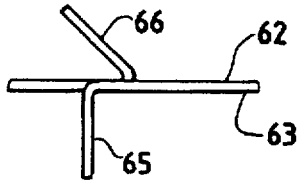
FIG. 10
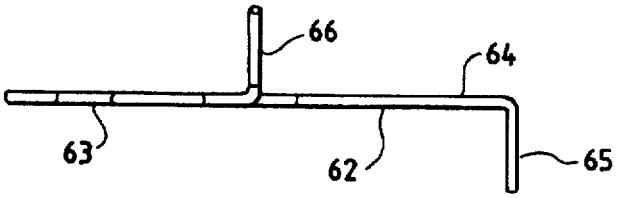
FIG. 12
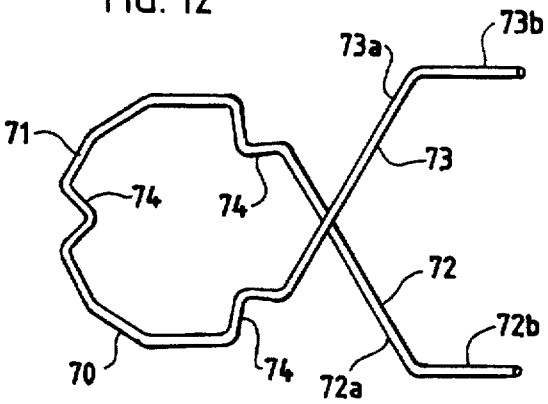
FIG. 13
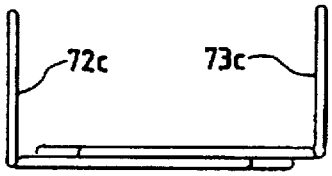
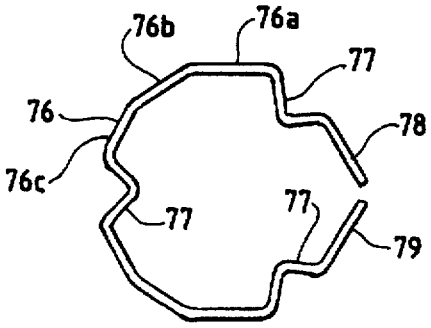
FIG. 14

MANTLE AND SPRING CLIP ASSEMBLY

BACKGROUND

This invention relates to mantles for use with lanterns. More particularly, the invention relates to a mantle and a spring clip for removably attaching the mantle to the burner assembly of a lantern.

Lanterns which burn liquid fuel or LP fuel are well known. Such lanterns include a burner assembly to which the fuel is delivered and one or more catalytic mantles which are mounted on the burner assembly. The fuel burns within the catalytic mantle, and the mantle incandesces and provides a bright light.

Mantles are conventionally formed from mesh material as described in U.S. Pat. No. 4,533,317. The mantle is shaped like a small bag with one open end. The open end is secured around the outlet end of the burner tube of the burner assembly by a drawstring.

U.S. Pat. No. 5,116,220 describes a flexible metal clip for securing a mantle on a burner tube instead of a drawstring. When the ends of the clip are squeezed together, the diameter of the bight portion increases, so that the open end of the mantle can be inserted over the outlet end of the burner tube. When the ends of the clip are released, the clip secures the mantle around the burner tube.

Mantles are very fragile after they have been fired by igniting the mantle for the first time. The fired mantles are subject to shear stresses when the lantern is bumped and Jarred during normal transportation and use. As a result, the mantle may break and fail, requiring replacement.

The spring clip described in U.S. Pat. No. 5,116,220 compresses substantially the entire periphery of the open mouth of the mantle against the metal burner tube of the lantern. We have found that such a spring clip substantially increases the stresses on the mantle when the lantern is bumped or Jarred as compared to a mantle which is attached by a conventional drawstring. A mantle which is secured by such a spring clip therefore less durable than a mantle which is secured by a drawstring.

SUMMARY OF THE INVENTION

The invention provides a spring clip with a plurality of inwardly extending V-shaped projections on the circular central portion of the clip. The mantle is secured to the burner tube of a lantern only by the V-shaped projections, and the portions of the mantle between the V-shaped projections remain substantially uncompressed by the clip. Stresses on the mantle are thereby substantially reduced when the lantern is jarred or shocked, and the durability of the mantle is substantially the same as the durability of a mantle which is secured with a drawstring.

When the clip is relaxed, the diameter of the central portion is greater than the diameter of the burner tube, and the open end of the mantle and the clip can be easily inserted over the end of the burner tube. The mantle is secured by squeezing the ends of the clip together to reduce the diameter of the central portion, and the ends are secured together. The positive securement of the ends of the clip in the installed position retain the holding power of the clip even when the clip is heated by the burning fuel.

The invention also provides a tubular mantle with a pair of open ends. Each end of the mantle is secured by a spring clip. The clips allow both ends of the mantle to be attached without twisting the mantle.

DESCRIPTION OF THE DRAWINGS

The invention will be explained in conjunction with illustrative embodiments shown in the accompanying drawing, in which

FIG. 9 is a top plan view of another embodiment of a spring clip;

FIG. 10 is a side elevational view of the spring clip of FIG. 9;

FIG. 11 is an end view taken along the line 11—11 of FIG. 9;

FIG. 12 is a top plan view of still another embodiment of the spring clip;

FIG. 13 is an end view of the spring clip of FIG. 12;

FIG. 14 is a top plan view of another embodiment of the spring clip;

FIG. 22 showing the mantle being turned inside-out;

FIG. 23 illustrates inserting the open end of the inside-out mantle through the central portion of a clip;

FIG. 24 illustrates folding back the open end of the inside-out mantle to form a hem which surrounds the clip and which is secured by stitching;

FIG. 25 illustrates inverting the inside-out mantle to an outside-out condition; and FIG. 26 is a fragmentary sectional view showing the inside-out mantle in phantom and the outside-out mantle in solid outline.

DESCRIPTION OF SPECIFIC EMBODIMENTS

Figure 1:
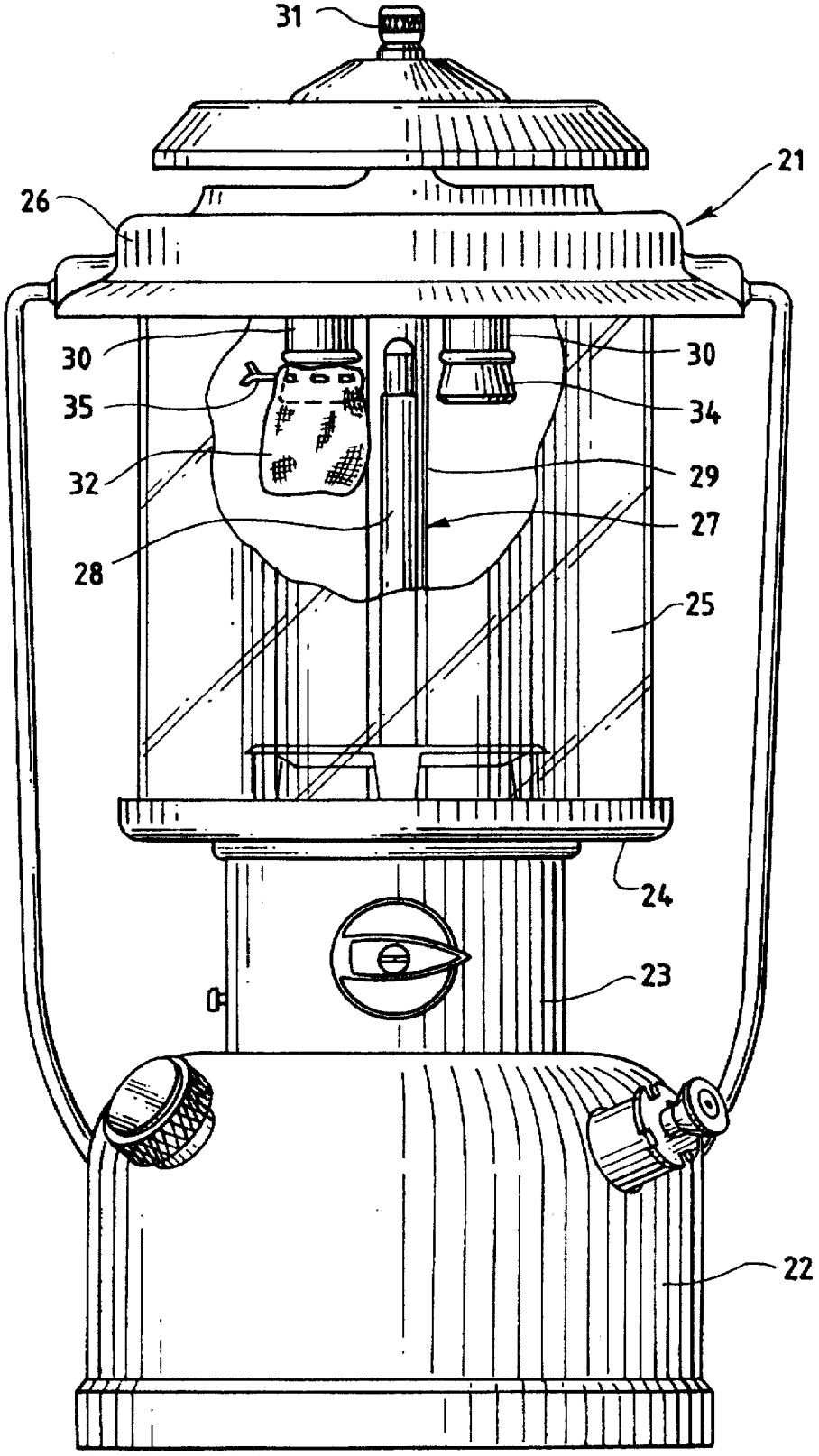
FIG. 1 is a fragmentary front elevational view of a lantern which is equipped with a mantle and spring clip assembly in accordance with the invention.

FIG. 1 illustrates a conventional liquid-fuel lantern 21 which includes a fuel tank or fount 22, a cylindrical collar 23 and a pan 24 which are supported by the fuel tank, a globe 25 which is supported by the pan 24, and 8 ventilator cap 26 which is supported on top of the globe. A metal burner assembly 27 extends upwardly within the globe and includes a generator tube 28, an air inlet tube 29, and a pair of downwardly extending outlet tubes 30. The ventilator cap 26 is secured to the burner assembly by a nut 31.

A fuel/air mixture flows through the open bottom end of each of the outlet tubes 30, and a bag-type catalytic mantle 32 is mounted on each burner tube. Only one mantle is illustrated in FIG. 1. The fuel-air mixture burns within the mantles, and the incandescent mantles provide a bright light. The lantern and bag-type mantles are conventional and well known, and a more detailed description is unnecessary.

Each of the burner tubes 30 has a conventional annular recess or groove 34 which is used to secure the mantle to the burner tube. A conventional bag-type mantle includes a drawstring which is threaded in and out of the mesh material of the mantle around the open end of the mantle. The open end of the mantle is inserted over the lower end of the burner tube 30, and the drawstring is tightened in the annular recess 34, the ends may be tied, and the excess string is cut off.

Figure 2:
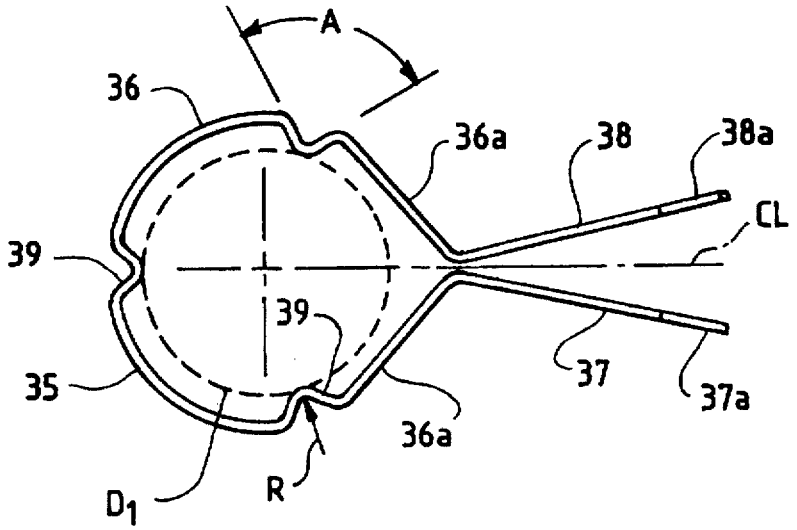
FIG. 2 is a top plan view of the spring clip of FIG. 1 in a relaxed condition.
Figure 3:
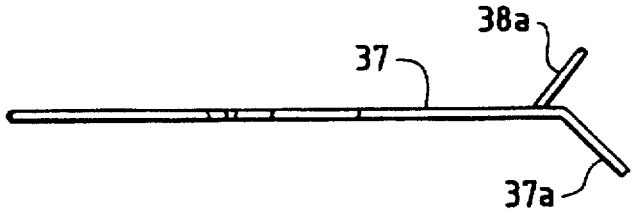
FIG. 3 is a side elevational view of the spring clip of FIG. 2.
Figure 4:
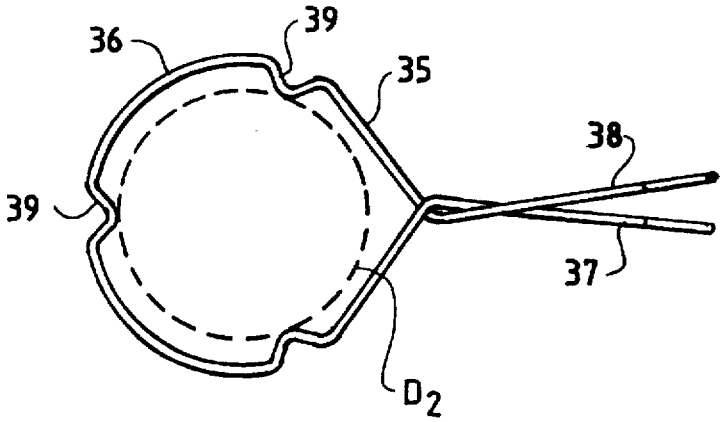
FIG. 4 is a top plan view of the spring clip of FIG. 2 with the ends squeezed together and secured.

The bag-type mantle illustrated in FIG. 1 is secured to the burner tube 30 by a resilient wire spring clip 35 (see also FIGS. 2–4). Each clip includes a generally circular central portion or bight portion 36 and a pair of elongated ends 37 and 38. The end 37 terminates in an end portion 37*a* which is inclined downwardly from the plane of the bight portion, and the end 38 terminates in an end portion 38*a* which is inclined upwardly from the plane of the bight portion.

The bight portion includes a plurality of radially inwardly extending V-shaped projections 39 Which reduce the area of contact between the mantle and the burner tube 30. The mantle is not pressed against the burner tube between the V-shaped projections, and those portions of the mantle are therefore not subjected to the stresses which would otherwise occur when the lantern is subjected to the normal bumps and shocks which occur during transportation and use. The durability of the mantle is thereby substantially increased.

As will be explained more fully hereinafter, when the clip is installed on the mantle, the bight portion extends into and out of the mesh material around the open end of the mantle.

FIG. 2 illustrates the spring clip in a relaxed condition. The ends 57 and 58 are separated, and the inscribed diameter $D_1$ of the projections 39 is slightly larger than the outside diameter of the burner tube 30. The open end of the mantle can therefore be easily slipped over the bottom of the burner tube. The ends 37 and 38 are then squeezed together as shown in FIG. 4 to reduce the inscribed diameter $D_2$ of the V-shaped projections 39, and the clip is retained in the stressed condition by crossing the ends 37 and 38 over each other. The inscribed diameter $D_2$ is approximately the same as the diameter of the annular groove 34 in the burner tube 30 and the clip is thereby retained in the annular groove. The ends 37 and 38 act as lever arms for reducing the diameter of the bight portion, and the angled end portions 37*a* and 38*a* facilitate squeezing the ends together with the fingers of one hand.

The mantle can be removed for replacement by following the reverse procedure. The ends 37 and 38 of the clip are uncrossed to allow the clip to relax. The bight portion 36 enlarges, and the mantle and clip can easily slip off of the burner tube.

In one specific embodiment of the clip 35 illustrated in FIGS. 2–4, the clip was formed from 0.032 inch diameter ½ hard 302/304 stainless steel wire. The bight portion included three V-shaped projections 39. The angular Spacing between the projections at about 10 o'clock and about 9 o'clock and between the projections at about 5 o'clock and about 9 o'clock was 108°. The inscribed diameter $D_1$ of the relaxed clip was 0.92 inch, and the outside diameter of the bight portion was 1.16 inch. The bight portion terminated in a pair of straight portions 36*a* which extended at an angle of 48° to the longitudinal centerline CL of the clip when the clip was relaxed. The outside surface of each of the V-shaped projections curved along a radius R of 0.03 inch and the sides of the V formed an included angle A of 90°. The included angle between the relaxed ends 37 and 38 was 24°.

The holding force applied by the spring clip which retains the mantle on the burner tube is provided by the positive latching of the cries-crossed ends of the clip. Because of this positive latch arrangement, the clip is less likely to relax its holding power due to loss of memory as the clip is heated by the burning fuel within the mantle. In contrast, the ends of the clip of U.S. Pat. No. 5,116,220 are not secured when the mantle is installed, and the diameter of the bight portion can increase if the end portions and bight portion relax because of loss of memory as the clip is heated. The clip of this invention can therefore use less temperature-tolerant material than the clip of U.S. Pat. No. 5,116,220.

Figure 5:
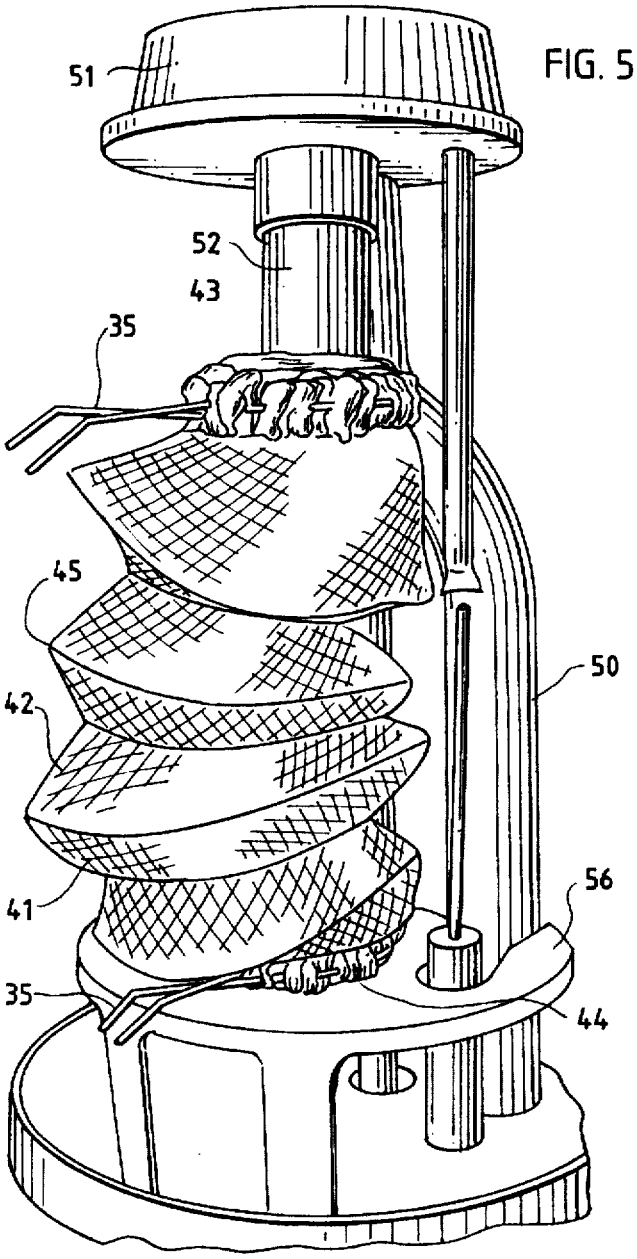
FIG. 5 is a fragmentary perspective view of a tubular mantle and spring clip assembly installed on the burner assembly of a lantern.
Figure 6:
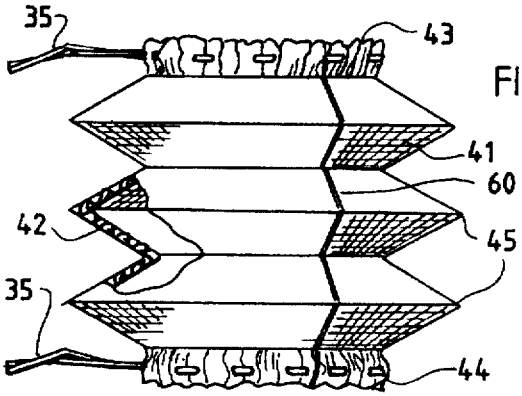
FIG. 6 is a fragmentary side view of the tubular mantle and clip assembly of FIG. 5.
Figure 8:
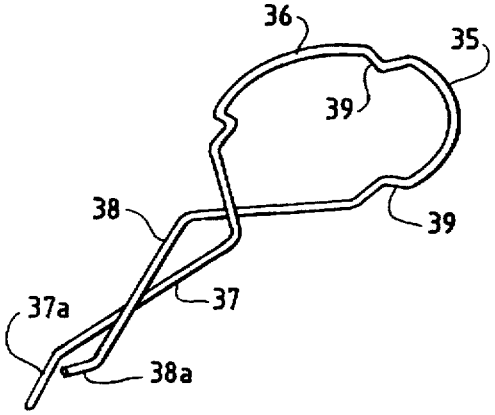
FIG. 8 is a perspective view of the spring clip with the ends secured together.

FIGS. 5 and 6 illustrate an elongated tubular mantle 41 which has a generally tubular side wall 42 and a pair of open ends 43 and 44. The tubular or generally cylindrical side wall 42 is provided with a plurality of axially spaced accordion pleats 45. The accordion pleats allow the mantle to be compressed axially for compact packaging and allow the mantle to be extended axially for ease of attachment to the lantern.

The tubular mantle illustrated in FIGS. 5 and 6 has not been subjected to initial burnoff or sintering. The mantle material is therefore still flexible, and the accordion pleats are very evident. After initial burnoff, the mantle assumes a more cylindrical shape.

A resilient wire spring clip 35 is attached to each end of the mantle. The tubular mantle is also formed of conventional mantle mesh material, and the bight portion extends in and out of the mesh material around the open end of the mantle.

Figure 7:
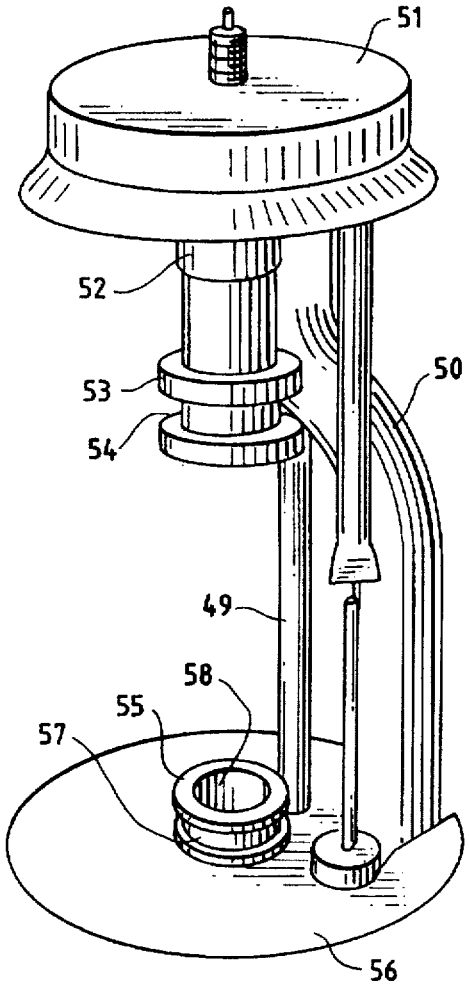
FIG. 7 is a fragmentary perspective view of the burner assembly of FIG. 5 without the mantle.

FIG. 7 illustrates a burner assembly 48 which is designed for use with the tubular mantle 42. The burner assembly includes a generator tube 49 which communicates with the fuel tank and an inlet tube 50. The upper end of the generator tube 49 extends through an opening in the inlet tube 50, and the inlet tube is connected to a generally cylindrical burner top 51. An outlet tube 52 extends downwardly from the burner top, and an annular fitting 53 is secured to the bottom end of the outlet tube. The fitting is provided with an annular groove 54 for supporting one end of the tubular mantle 42. The lower end of the mantle is supported by a plug 58 which is mounted on a heat shield 56. The plug is provided with an annular groove 57 for securing the mantle and a closed top surface 58 which closes the lower end of the mantle.

The elongated tubular shape of the mantle enhances uniform and more efficient light emission compared to standard bag-type or rosette mantles. The accordion pleats of the mantle not only allow the mantle to be compressed and extended, but also promote initial burnoff of the mantle.

The upper open end of the mantle is inserted over the fitting 53 on the burner tube 52, and the upper spring clip 35 is compressed within the annular groove 54 by squeezing the ends of the clip together and securing the ends by crossing them over each other. Similarly, the open lower end of the tubular mantle is inserted over the plug 55, and the lower spring clip is secured within the groove 57 by squeezing the ends of the clip together and securing the ends. To assist in properly installing the mantle, the side wall of the mantle may be imprinted with an axial stripe 60 (FIG. 6) to ensure that the mantle is not twisted.

Another embodiment of a spring clip 62 is illustrated in FIGS. 9–11. The spring clip 62 also includes a substantially circular bight portion 63, a substantially straight end portion 64 which extends generally radially from the bight portion and terminates in a downwardly extending end portion 65, and a hook end portion 66 which extends generally perpendicularly to the end portion 64. The bight portion 63 includes three generally V-shaped projections 67 which extend generally radially inwardly.

Referring to FIG. 9, the V-shaped projections 69 at approximately one o'clock and at approximately nine o'clock are spaced apart about 127°. The V-shaped projections at approximately 5 o'clock and at approximately 9 o'clock are also spaced apart about 127°. The V-shaped projections at approximately 1 o'clock and approximately 5 o'clock are spaced apart about 106°. The bight portion 63 between the V-shaped projections is not exactly arcuate but instead consists of a plurality of straight segments 63*a*, 63*b*, 63*c*, etc. which form a polygonal but substantially circular periphery between the V-shaped projections.

In one specific embodiment of the clip 62, the circumscribed diameter inside of the V-shaped projections 67 was 0.29 inch, which was sufficient to allow the open end of the mantle and the clip to be inserted over the burner tube of a lantern. The mantle was then secured by squeezing the end 64 toward the end 66 and hooking the end 64 over the hook-shaped end 66 in a manner similar to a safety clip. The hook-shaped end portion 66 retains the end 64 in a compressed condition, and the inscribed diameter inside of the V-shaped projections is reduced to retain the clip within the annular groove of the burner tube.

The clip 62 was formed from 302/304 ½ hard stainless steel wire having a diameter of 0.032 inch.

FIGS. 12–13 illustrate a spring clip 70 which has a central or bight portion 71 and a pair of end portions 72 and 73. Each end portion has a first straight portion (72*a*, 73*a*) which extends generally tangentially from the bight portion, second gripping portions (72*b*, 73*b*) which extend generally parallel to each other, and end portions (72*c*, 73*c*) which extend perpendicularly to the plane of the bight portion. The bight portion 71 includes three V-shaped projections 74.

In contrast to the clips of FIGS. 2–4 and 9–11, the clip 70 has a smaller inscribed diameter inside the V-shaped projections 74 when the clip is in the relaxed or non-stressed condition of FIG. 12. When the ends 72 and 73 are squeezed together, the inscribed diameter inside of the projections 74 enlarges, and the clip can be inserted over the end of a burner tube. When the ends 72 and 73 are released, the inscribed diameter of the projections decreases to secure the clip and the mantle within the annular groove of the burner tube.

The clip 70 is similar to the clip of U.S. Pat. No. 5,166,220, except that the clip 70 has the V-shaped projections which minimizes the compressive force on the mantle between the spring clip and the burner tube. One specific embodiment of the clip was formed from 302/304 ½ hard stainless steel wire having a diameter of 0.032 inch.

FIG. 14 illustrates another spring clip 76. The spring clip 76 is substantially circular and includes three V-shaped projections 77. The clip includes a plurality of straight segments 76*a*, 76*b*, and 760 between two pairs of V-shaped projections, and a pair of straight end portions 78 and 79.

When the clip 76 is in the relaxed or unstressed condition illustrated in FIG. 14, the inscribed diameter of the V-shaped projections 77 is substantially the same as the diameter of the annular groove of the burner tube. The mantle and clip are installed on the burner tube by forcing the spring clip over the bottom end of the burner tube, which is conventionally radiused or chamfered. The ends 78 and 79 of the clip are forced apart by the burner tube, and the mantle and clip are pushed upwardly on the burner tube to the annular recess in the burner tube. When the clip reaches the annular recess, the clip contracts into the recess and retains the mantle on the burner tube.

One specific embodiment of the clip 76 was formed from 302/304 ½ hard stainless steel wire having a diameter of 0.031 inch.

Each of the clips illustrated and described herein can be used with conventional bag-type mantles, conventional rosette mantles, and the novel tubular mantle described herein. Mantles equipped with these clips can be installed in cold conditions while wearing gloves and can be installed in the dark by feel. Also, there is no need to cut off excess drawstring which, if not removed, can knock holes in the fragile mantle material as the mantle is being burned off.

Figure 15:
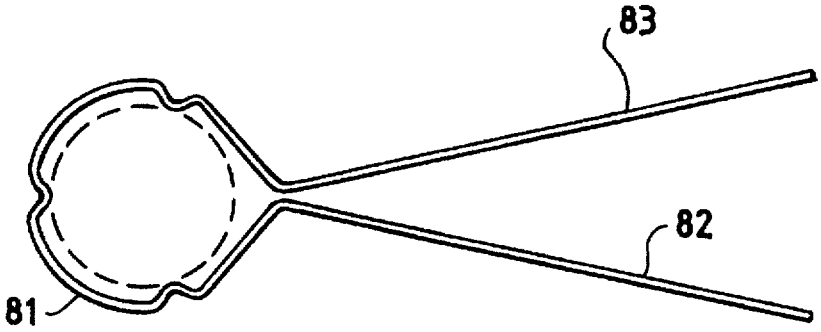
FIG. 15 is a plan view of a wire preform for forming a spring clip.

The preferred manner of attaching the spring clips to the mantle is by threading the spring clip through the mesh material of the mantle in the same manner as convention drawstrings are threaded through the mantle material. However, The preferred method of attaching the spring clip to the mantle is illustrated in FIGS. 15–21. FIG. 15 illustrates a preform 81 for the spring clip 35 of FIGS. 2–4. The preform is similar go the final clip 35 except that the ends 82 and 83 of the preform are longer than the ends 37 and 38, and the ends 82 and 83 are straight without deformed end portions 37*a* and 38*a*. In one Specific embodiment the ends 82 and 83 were 2.75 inches long.

Figure 16:
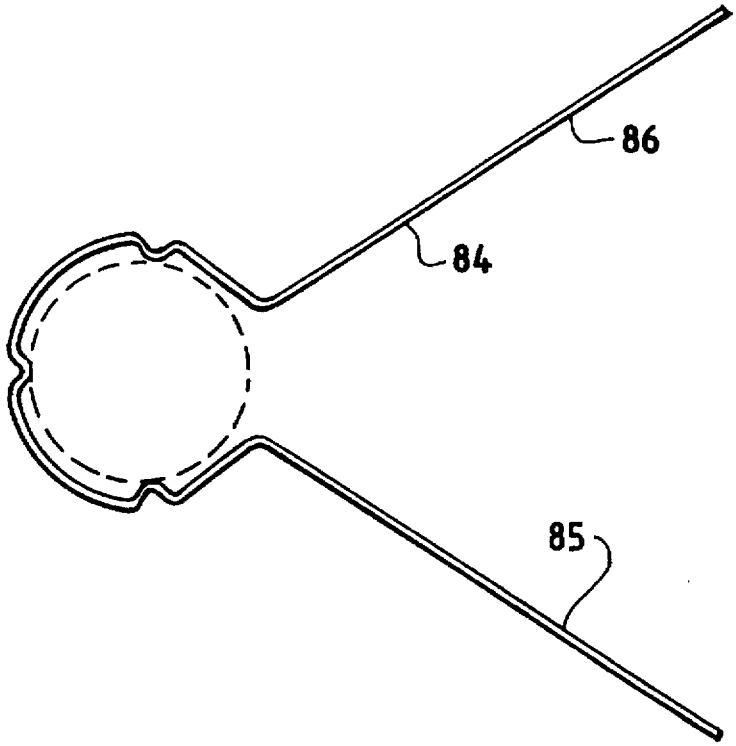
FIG. 16 is a plan view of another wire preform for forming a spring clip

FIG. 16 illustrates a preform 84 which is similar to the preform 81, but the legs 85 and 86 form a wider included angle in the relaxed position. The specific dimensions on FIGS. 15 and 16 are exemplary, and other dimensions could be used.

Figure 17:
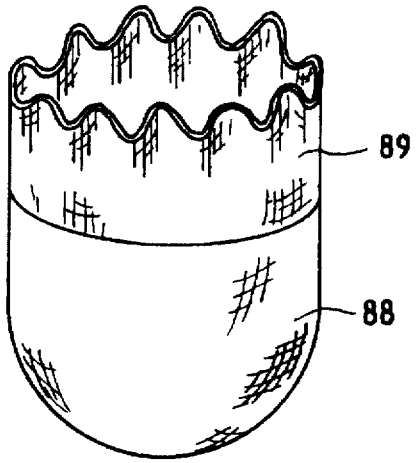
FIG. 17 is a perspective view of a bag-type mantle.
Figure 18:
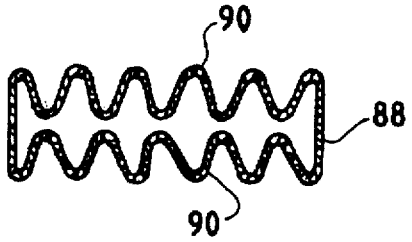
FIG. 18 is a sectional view of pleats which are formed in the open end of the mantle by a pleater head.

Referring to FIG. 17, the open end of a mantle 88 is folded over to form a double layer 89 of mesh material and is inserted into a conventional pleater head which has heretofore been used for threading drawstrings into mantles. A divider plate is inserted into the mouth of the mantle, and the mesh material of the mantle on each side of the divider plate is formed into a plurality of pleats 90 or zig sag folds (FIG. 18) by a jaw on each side of the plate. Each jaw has an opening which extends through the zig zag surfaces of the jaw.

Figure 19:
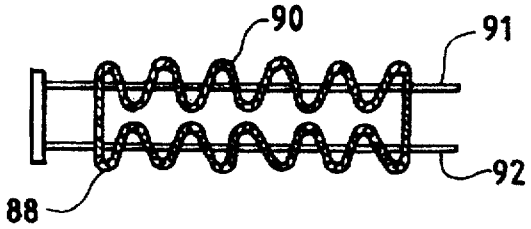
FIG. 19 is a view similar to FIG. 18 showing a pair of hollow needles inserted through the pleats.
Figure 20:
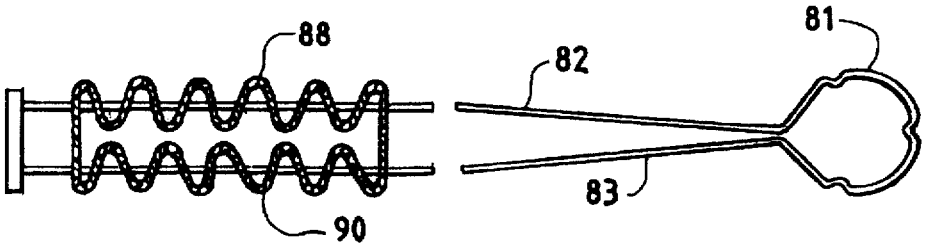
FIG. 20 is a view similar to FIG. 19 showing the ends of a preform being inserted into the ends of the hollow needles.
Figure 21:
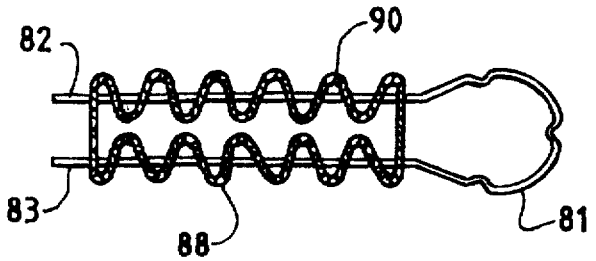
FIG. 21 is a view similar to FIG. 20 after the needles have been withdrawn to draw the ends of the preform through the pleats of the mantle.

Large hollow needles 91 and 92 are inserted through the openings in the jaws and through the pleats of the mesh material as shown in FIG. 19. The tips of the ends 82 and 83 of the preform 81 are inserted into the open ends of the hollow needles (FIG. 20). The tips are retained in the needles by friction and by the spring force which is exerted by the ends 82 and 83, which must be stressed in order to be inserted into the parallel needles. The needles are then withdrawn from the jaws, and the ends 82 and 83 are pulled by the needles through the pleats of the mesh as shown in FIG. 21. The needles are then removed from the ends 82 and 83.

After the ends 82 and 83 are inserted through all of the pleats, the mantle is removed from the pleater head, and the mesh material is pushed manually from the straight ends 82 and 83 to the circular bight portion of the preform. Thereafter, the ends 82 and 83 are cut off to the desired length, and the end portions are deformed to form the inclined portions 37*a* and 38*a*.

The clips of FIG. 9–14 are attached to a mantle in the same way. The preform 81 can be used for all of the clips. After the mantle is mounted on the bight portion of the preform, the ends 82 and 83 are out to the appropriate length and formed to provide the final shape of the clip.

The V-shaped projections of the clips extend inwardly from the generally circular portion of the clip a distance which is substantially the same as or greater than the thickness of the mantle material between the projections. The mantle material between the projections is therefore substantially uncompressed by the clip when the projections engage the burner tube.

Figure 22:
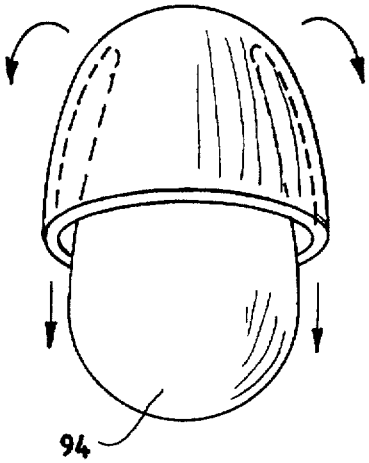
FIGS. 22–26 illustrate a modified method of attaching a spring clip to the open end of a mantle.
Figure 23:
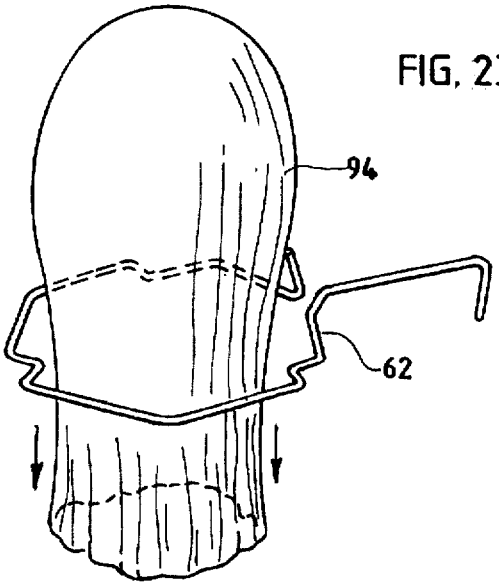
Figure 24:
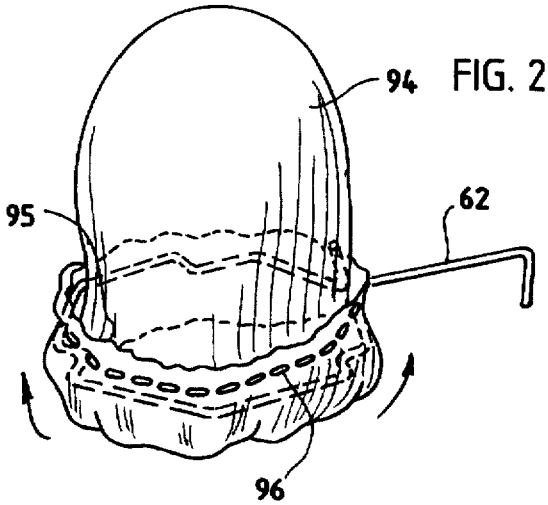
Figure 25:
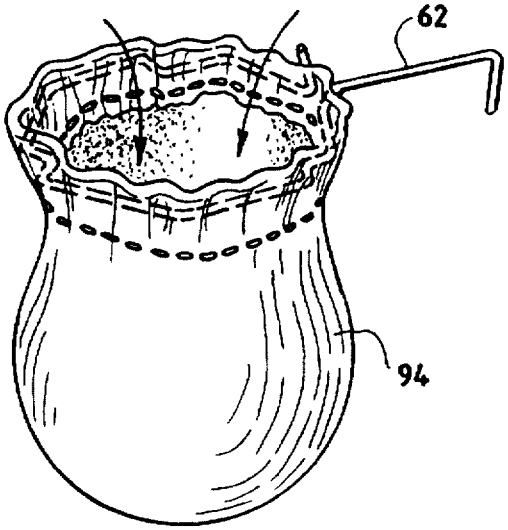
Figure 26:
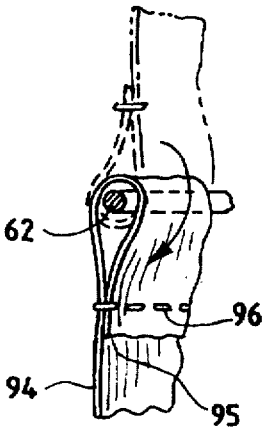

An alternate method of attachment is illustrated in FIGS. 22–26. A bag-type mantle 94 is inverted or turned inside-out as illustrated in FIG. 22. Alternatively, the mantle can be manufactured in an inside-out condition. The open end of the inside-out mantle is inserted through the bite portion of a clip as illustrated in FIG. 23, clip 62 being shown for purposes of illustration. The end portion 95 of the mantle whioh surrounds the open end is then turned upwardly over the bight portion of the clip to form a hem as illustrated in FIG. 24, and the hem is stitched to the bag portion of the mantle by stitching 96 to enclose the bight portion of the spring between the hem and the bag portion of the mantle. The mantle is then invented or turned outside-out as illustrated in FIG. 25 so that the end portion 95 which forms the hem is on the inside of the mantle as illustrated in FIG. 26.

While in the foregoing specification a detailed description of specific embodiments of the invention was set forth for the purpose of illustration, it will be understood that many of the details herein given may be varied considerably by those skilled in the art without departing from the spirit and scope of the invention.

We claim:

1. A mantle assembly for a lantern having a burner tube, the mantle assembly comprising:

a mantle having at least one opening adapted to fit over a lantern burner tube, and a flexible and resilient spring clip for releasably securing the opening of the mantle to a lantern burner tube, the spring clip having a generally circular central portion which extends around the opening of the mantle and a pair of ends which extend from the central portion, the ends being movable between a first, relaxed position in which the ends are separated and the central portion forms a first sized opening and a second, stressed position in which the ends are secured together and the central portion forms a second sized opening which is smaller than the first sized opening, the central portion including a plurality of generally V-shaped generally radially inwardly extending projections which are adapted to engage a lantern burner tube.

2. The mantle assembly of claim 1 in which the clip includes three generally V-shaped projections which are spaced apart around the central portion of the clip.

3. The mantle assembly of claim 2 in which one of the ends of the clip includes a hooked portion and the other end of the clip is inserted into the hooded portion when the ends are in the second position.

4. The mantle assembly of claim 1 in which the mantle is generally tubular and has a second opening, and a second of said flexible and resilient spring clips for releasably securing the second opening of the mantle to a lantern.

5. A mantle assembly for a lantern having a burner tube, the mantle assembly comprising:

a mantle having at least one opening adapted to fit over a lantern burner tube, and a flexible and resilient spring clip for releasably securing the opening of the mantle to a lantern burner tube, the spring clip having a generally planar circular central portion which extends around the opening of the mantle and a pair of elongated, generally straight portions which extend from the central portion generally in the plane of the central portion, a first angled end portion which extends from one of the straight portions to a position above the plane of the central portion, and a second angled end portion which extends from the other of the straight portions to a position below the plane of the central portion, the straight portions being movable between a first, relaxed position in which the straight portions are separated and the central portion forms a first sized opening and a second, stressed position in which the straight portions are crossed over each other to secure the straight portions together and the central portion forms a second sized opening which is smaller than the first sized opening.

6. The mantle assembly of claim 5 in which the ends of the clip in the second, stressed position are crossed over each other to secure the ends together.

7. The mantle assembly of claim 5 in which the clip is threaded in and out of the mantle around the opening therein.

8. The mantle assembly of claim 5 in which the spring clip is formed from stainless steel wire having a diameter of about 0.032 inch.

9. A mantle assembly for a lantern having a burner tube, the mantle assembly comprising:

a mantle having at least one opening adapted to fit over a lantern burner tube, and a flexible and resilient spring clip for releasably securing the opening of the mantle to a lantern burner tube, the spring clip having a generally circular central portion which extends around the opening of the mantle, the central portion including a plurality of generally V-shaped generally radially inwardly extending projections Which are adapted to engage a lantern burner tube.

10. The mantle assembly of claim 9 in which the clip includes three generally V-shaped projections which are spaced apart around the central portion of the clip.

11. The mantle assembly of claim 9 in which the clip includes a pair of ends which extend from the central portion, the ends being movable between a first position in which the V-shaped projections define a first inscribed diameter and a second position in which the V-shaped projections define a second inscribed diameter which is different than the first diameter.

12. The mantle assembly of claim 9 in which the spring clip is formed from stainless steel wire having a diameter of about 0.032 inch.

13. The mantle assembly of claim 9 in which each of the V-shaped projections extends radially inwardly from the central portion of the clip a distance greater than the thickness of the mantle whereby the mantle is substantially uncompressed by the clip between the V-shaped projections when the mantle is secured to a lantern burner tube.

14. A mantle assembly for a lantern comprising:

an elongated generally tubular mantle having a tubular side wall and a pair of open ends, a first flexible and resilient spring clip extending around one of the mantle openings and a second flexible and resilient spring clip extending around the other mantle opening, each of the spring clips having a generally circular central portion, the central portion including a plurality of generally V-shaped generally radially inwardly extending projections.

15. The mantle assembly of claim 14 in which each clip includes three generally V-shaped projections which are spaced apart around the central portion of each clip.

16. The mantle assembly of claim 14 in which each clip includes a pair of ends which extend from the central portion, the ends being movable between a first position in which the V-shaped projections define a first inscribed diameter and a second position in which the V-shaped projections define a second inscribed diameter which is different than the first diameter.

17. The mantle assembly of claim 16 in which the ends of each clip are movable between a first, relaxed position in which the ends are separated and the central portion of the clip forms a first sized opening and a second, stressed position in which the ends are secured together and the central portion of the clip forms a second sized opening which is smaller than the first sized opening.

18. The mantle assembly of claim 14 in which each of the clips is formed from stainless steel wire having a diameter of about 0.032 inch.

19. The mantle assembly of claim 18 in which each of the V-shaped projections extends radially inwardly from the central portion of the clip a distance greater than the thickness of the mantle whereby the mantle is substantially uncompressed by the clip between the V-shaped projections when the mantle is secured to a lantern burner tube.

20. A method of attaching a spring clip to a mantle having an open end, the spring clip having a generally circular central portion and a pair of end portions which extend outwardly from the central portion, comprising the steps of:

forming two sets of pleats in the mantle around the open end thereof, inserting a hollow needle through each of the sets of pleats, inserting the end portions of the clip into the hollow needles, withdrawing the needles from the pleats and thereby drawing the end portions of the clip through the pleats, removing the needles from the end portions of the clip, and moving the mantle from the end portions of the clip to the central portion of the clip.

21. The method of claim 20 including the step of deforming a portion of each of the end portions of the clip after the mantle is moved to the central portion of the clip.

22. The method of claim 20 including the step of cutting off a portion of each of the end portions of the clip after the mantle is moved to the central portion of the clip.

23. The method of claim 20 including the steps of cutting off a portion of each of the end portions of the clip to form a pair of shortened end portions and deforming each of the shortened end portions.

* * * * *

UNITED STATES PATENT AND TRADEMARK OFFICE

CERTIFICATE OF CORRECTION

PATENT NO. : 5,639,231

DATED : June 17, 1997

INVENTOR(S) : Randall L. May et al

It is certified that error appears in the above-indentified patent and that said Letters Patent is hereby corrected as shown below:

Col. 7, line 62 change "hooded" to --hooked--.

Signed and Sealed this

Second Day of September, 1997

*Attest:*

Bruce Lehman

BRUCE LEHMAN

*Attesting Officer*

*Commissioner of Patents and Trademarks*